United States Patent [19]

Cooper

[11] Patent Number: 4,621,582

[45] Date of Patent: Nov. 11, 1986

[54] COAL BURNER

[75] Inventor: James Cooper, Glasgow, Scotland

[73] Assignee: James Howden & Company Ltd., Glasgow, Scotland

[21] Appl. No.: 710,990

[22] Filed: Mar. 12, 1985

[30] Foreign Application Priority Data

Mar. 13, 1984 [EP] European Pat. Off. ..... 84301708.8

[51] Int. Cl.[4] ..... F23D 1/02

[52] U.S. Cl. ..... 110/264; 110/263; 110/347

[58] Field of Search ..... 110/263, 264, 347, 265, 110/266

[56] References Cited

U.S. PATENT DOCUMENTS 4,147,116 4/1979 Graybill ..... 110/264 X 4,206,712 6/1980 Vatsky ..... 110/264

4,412,496 11/1983 Trozzi ..... 110/264 X 4,423,689 1/1984 Merz et al. ..... 110/264 X 4,448,135 5/1984 Dougan et al. ..... 110/264 X 4,471,703 9/1984 Vatsky et al. ..... 110/264 X

*Primary Examiner*—Edward G. Favors

*Attorney, Agent, or Firm*—Barnes & Thornburg

[57] ABSTRACT

A coal burner comprising a combustion chamber (18), a main nozzle (21) for particulate coal and a primary air supply opening (19) in said combustion chamber, a pilot nozzle (23) having an outlet (25) adjacent the outlet (26) to the main nozzle, a feed line (28) for feeding a mixture of ultrafine pulverized coal and an inert gaseous fluid to said pilot nozzle (23), and a separator (30) in said feed line for increasing the concentration of ultrafine coal to gaseous medium in said mixture.

8 Claims, 1 Drawing Figure

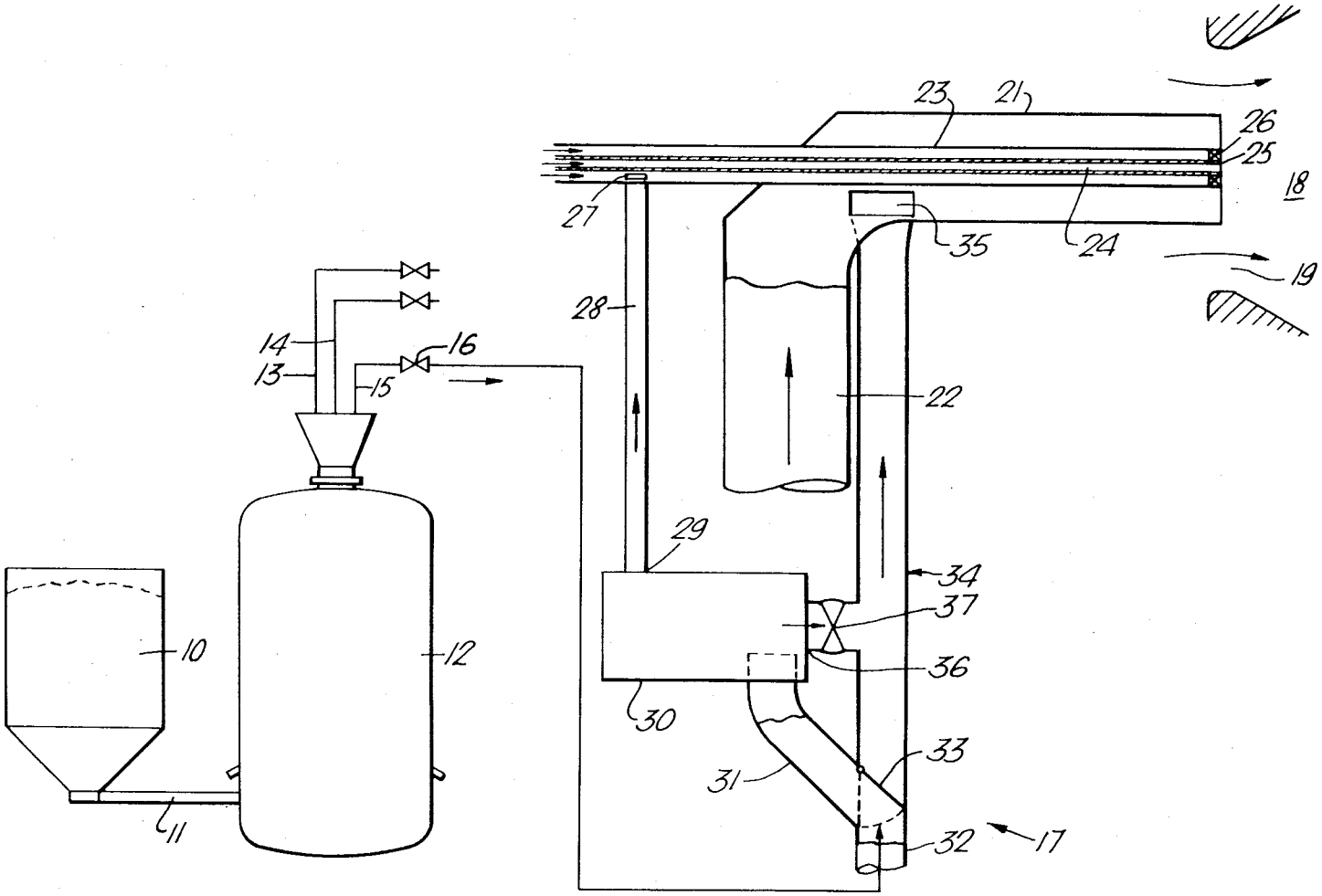
18
19
26
25
24
21
23
35
22
34
37
36
33
32
17
31
29
30
27
28
16
15
12
14
13
10
11

COAL BURNER

DESCRIPTION

The present invention relates to a coal burner.

It has been traditional to operate pulverized coal burners by feeding particulate coal of approximately 72–75% by weight less than 76 microns in particle size to a coal burner combustion chamber via a nozzle and to provide at a location adjacent said nozzles, for example coaxial therewith, a supply of oil which is injected via an atomizer into the combustion chamber, particularly during the light up and low load firing of the burner. Once sufficient heat has been evolved by the oil burner, ignition of the coal itself can take place. Furthermore, during low duty operation, for example 50% of full load, the oil is again required to provide stability of the flame.

U.S. Pat. No. 4,147,116 shows a similar light up arrangement for a burner using ultrafine coal of a particle size less than 40 microns, the arrangement there being to centrifuge the coal particles to the periphery of the burner tube, so that it is adjacent the incoming combustion air. Unless the oil or gas burner is provided at the centre, such a system would be totally unstable at low load or during light up.

The use of oil as a low load support fuel and during light up or ignition has certain disadvantages. Firstly, the oil itself is significantly more expensive, and in some parts as much as five times more expensive, than the coal for a particular calorific value. Secondly, it has been suggested to use, in place of the oil, an ultrafine pulverized coal which is stored in a bin and fed, when required, in place of, or in addition to the oil. However, some difficulties have been found in either adapting an existing oil burner or designing a new burner which can operate satisfactorily with ultrafine coal as a light up or low load fuel.

GB-A No. 2093979 discloses a burner system for burning coal dust, which is usually recognized as referring to a pulverised fuel of which 70% is less than 70 microns. There are seven coaxial tubes arranged with their common axis vertical. The outermost tube is used as a main air inlet, the next tube for the power fuel dust. An innermost tube is used as a supply for an igniting gas and this is surrounded by a tube for air for this gas, this in turn being surrounded by a tube for ignition coal dust. Outside this is a tube for the air for this dust and then surrounding this and inside the tube for power fuel dust, is a tube for additional ignition coal dust. All of the coal dust, i.e. the power coal dust, the ignition coal dust and the additional ignition coal dust flow vertically downwardly under gravity, but can be blown in. Such a system is extremely complex and is unlikely to operate in a stable manner.

Further methods of operation of coal burning are disclosed in U.S. Pat. Nos. 4,190,005; 4,241,673; 4,226,371 and 4,270,895, but these are relatively complex and/or likely to be unstable in operation.

It is now proposed, according to the present invention, to provide a coal burner comprising a combustion chamber, a main nozzle for particulate coal and a primary air supply opening into said combustion chamber, an igniter nozzle mounted generally centrally within the main nozzle and having an outlet adjacent the outlet to the main nozzle, a feedline for feeding a mixture of ultrafine pulverized coal and an inert gaseous fluid to said pilot nozzle and a separator in said feedline at a location thereof upstream of and spaced from said burner for increasing the concentration of ultrafine coal to gaseous medium in said mixture.

By using a separator to increase the concentration of the ultrafine coal to gaseous medium (which may for example be steam or flue gas), a very satisfactory fuel is provided for light up purposes, which has characteristics similar to that of the oil previously used.

The separator may be a centrifugal or other form of separator. A pipe may be provided to feed the gaseous medium separated from said mixture to said main nozzle. The gaseous medium separated out will in fact be the lighter fraction from the separator and will inevitably include some ultrafine coal and this can be burned in the main burner. The actual degree of separation would be controlled by a controllable throttle valve in the connection between the separator and the pipe.

Preferably the pipe includes a diverter valve enabling the mixture to be fed either to said separator or directed to main nozzle. When the burner is being used to introduce ultrafine coal as a support fuel, i.e. after light up, the diverter valve may be moved to feed the ultrafine coal direct to the main burner since it will act as a satisfactory support fuel without concentration, even if it is fed directly from the pulverizer used to form the ultrafine coal and the gaseous medium is that used to effect the pulverizing.

Advantageously, the pipe is connected tangentially to said main nozzle to introduce gaseous medium thereinto with a swirl. It is preferred that the main nozzle and the pilot nozzle should be concentric and that the feed line is connected tangentially to said pilot nozzle, to introduce the concentrated mixture of ultrafine coal and gaseous medium into said pilot nozzle with a swirl. Then, desirably, the tangential connection of the feed line to the pilot nozzle and the tangential connection to the pipe to the main nozzle are arranged to produce a swirl in the same rotational sense.

Such an arrangement produces a powerful swirl and the presence of this swirl produces a central recirculation zone of hot gases and hot ultrafine coal which further enhances the flame stability.

It is sometimes advantageous to have a supply of oil in addition at light up and an oil igniter conduit is mounted coaxially within said pilot nozzle and includes an atomizer adjacent the outlet of the pilot nozzle and the main nozzle.

In order that the invention may more readily be understood, the following description is given, merely by way of example, reference being made to the accompanying drawing, in which the sole FIGURE is a schematic side view of one embodiment of apparatus including a burner according to the invention.

Referring to the drawing, the apparatus illustrated comprises a feed coal bunker 10 from which coal with a top size of between 6 mm and 36 mm is fed via a feeder 11 to a pulverizer vessel 12. Superheated steam or an inert gas, such as a flue gas, is fed at an elevated temperature to a plurality of nozzles (not shown) which are mounted in an annular array with the nozzles each arranged to point upwardly and at an angle between a radius and a tangent to the annulus.

The pulverizer vessel 12 is shown with three outlet ducts 13, 14, 15, only one of which, duct 15, is shown being used according to the present invention. This duct passes via a discharge valve 16 to a burner indicated by the general reference number 17. The burner comprises a combustion chamber indicated generally at 18 and having an opening 19 for the inflow of combustion air from left to right as seen in the FIGURE. A main nozzle 21 is mounted coaxially to the opening 19 and is fed via a feed duct 22 with particulate pulverized coal of significantly higher diameter than the ultrafine pulverized coal flowing together with gaseous medium mixture from the pulverizer 12.

Mounted coaxially within the main nozzle 21 is an pilot nozzzle 23 having mounted coaxially therwithin an auxiliary oil inlet pipe 24 provided with an atomizer 25 at its discharge end. Within the nozzle 23 and surrounding the atomizer 25 is a swirler 26.

The pilot nozzle 23 is fed with light up air along its axis and with ultrafine coal via a tangential connection 27 from a feedline 28 which is connected to the heavy fraction outlet 29 of a centrifugal separator 30. This separator is fed via an inlet 31 which is connected to a pipe 32 which in turn is connected to the outlet 15 of the pulverizer 12. A diverter valve 33 is positioned within the pipe 32 and can be moved from the position illustrated in which fluid flowing in is directed along inlet 31 to the separator 30 to a second position in which the fluid flowing in is directed along the extension 34 of the pipe to a tangential inlet 35 to the main nozzle 21.

The light fraction outlet 36 of the centrifugal separator is provided with a throttle valve 37 by means of which the light fraction can be returned to the pipe extension 34 for feeding into the main nozzle 21.

In operation of the above described apparatus, coal is fed from the feed bunker 10 to the pulverizer 12 in which it is pulverized to an ultrafine state, that is with typically 50% by weight of the particles having a diameter of less than 12 microns. The relevant portion of the mixture of gaseous medium, that is superheated steam, or flue gas or some other inert gas, and the ultrafine coal is then passed via line 15 to the burner. In the ignition position indicated, the mixture flows into the separator 30 and a portion of the gaseous medium discharges via outlet 36 to the pip34 and thence is caused to flow tangentially with a swirl in the main nozzle 21.

The heavier fraction, that is a more concentrated mixture of ultrafine pulverized coal and gaseous medium flows along the feedline 28 and is again caused to swirl in the pilot nozzle 23 with the same direction of swirl. The mixture is at an elevated temperature, preferably of the order of 130° to 150° C. and in this condition is readily capable of igniting. When the temperature has risen sufficiently high within the combustion chamber, the main nozzle 21 can have the coal in a pulverized condition fed along it through feed pipe 22 and can be burned in a conventional way. Thereafter the supply of ultrafine pulverized coal can be cut off by closing the valve 16. In a low load condition, it is possible to reintroduce the ultrafine coal and in this condition it is possible to have the valve 33 in the non-illustrated position so that the coal and gaseous medium mixture is fed directly to the main burner without any concentration.

In certain circumstances, it is advisable for the ignition to take place with oil initially and for this reason the oil pipe 24 is provided and oil can be projected from that via the atomizer 25.

As indicated above, the tangential inlet 27 to the pilot nozzle 23 produces a measure of swirl and this can be increased by the swirler 26 adjacent the outlet to the pilot nozzle. The presence of this swirl produces a central recirculating zone of hot gases and hot ultrafine coal which further enhances the flame stability.

By using ultrafine coal instead of oil, or in certaih circumstances in addition to oil, a very significant saving in expense can be achieved and furthermore downstream of the furnace there is less fouling of economiser and air heater surfaces if one uses the coal rather than the oil.

It is also contemplated that in the support condition, the pulverized coal in the ultrafine condition could be fed other than at an elevated temperature although this is not preferred.

I claim:

1. A coal burner comprising:

(a) a combustion chamber;

(b) a main nozzle;

(c) means for feeding particulate coal to said main nozzle;

(d) a primary air supply opening into said combustion chamber around said main mozzle;

(e) a pilot nozzle mounted generally centrally within the main nozzle and having an outlet adjacent the outlet of the main nozzle;

(f) a separate feed line for feeding a mixture of ultrafine pulverized coal and inert gaseous fluid to said pilot nozzle;

(g) a centrifugal separator in said feed line at a location thereof upstream of, and spaced from said burner, effective to increase the concentration of ultrafine coal to gaseous medium in said mixture, which is fed to said pilot nozzle.

2. A burner according to claim 1, and further comprising a pipe to feed the gaseous medium separated from said mixture by said separator to said main nozzle.

3. A burner according to claim 1 and further comprising a connection between said separator and said pipe and a controllable throttle valve in said connection.

4. A burner according to claim 1, and further comprising a diverter valve in said pipe enabling the mixture to be fed either to said separator or directly to said main burner.

5. A burner according to claim 2 wherein said pipe is connected tangentially to said main nozzle to introduce gaseous medium thereinto with a swirl.

6. A burner according to claim 5, wherein said feed line is connected tangentially to said pilot nozzle to introduce a concentrated mixture of ultrafine coal and gaseous medium into said pilot nozzle with a swirl.

7. A burner according to claim 6, wherein the tangential connection of the feed line to the pilot nozzle and the tangential connection of the pipe to the main nozzle are arranged to produce a swirl in the same rotational sense.

8. A burner according to claim 1 and further comprising an oil igniter conduit mounted coaxially within said igniter nozzle and an atomizer in said oil pilot conduit adjacent the outlet of the pilot nozzle and the main nozzle.

* * * * *

UNITED STATES PATENT AND TRADEMARK OFFICE

CERTIFICATE OF CORRECTION

PATENT NO. : 4,621,582

DATED : November 11, 1986

INVENTOR(S) : James Cooper

It is certified that error appears in the above-identified patent and that said Letters Patent is hereby corrected as shown below:

At column 3, line 10, delete "therwithin" and insert therefor --therewithin--;

At column 3, line 41, delete "pip34" and insert therefor --pipe 34--;

At column 4, line 7, delete "certaih" and insert therefor --certain--;

At column 4, line 24, delete "mozzle" and insert therefor --nozzle--;

At column 4, line 60, delete "igniter" and insert therefor --pilot--; and

At column 4, line 60, delete "pilot" and insert therefor --igniter--.

Signed and Sealed this

Seventeenth Day of February, 1987

*Attest:*

DONALD J. QUIGG

*Attesting Officer* *Commissioner of Patents and Trademarks*